US008096717B2

(12) United States Patent
Kubota et al.

(10) Patent No.: US 8,096,717 B2
(45) Date of Patent: Jan. 17, 2012

(54) FEED DRIVE DEVICE FOR PRINTER AND PRINTER

(75) Inventors: Tomoyuki Kubota, Shiojiri (JP); Kenichi Nakajima, Shimosuwa-machi (JP)

(73) Assignee: Seiko Epson Corporation, Tokyo (JP)

( * ) Notice: Subject to any disclaimer, the term of this patent is extended or adjusted under 35 U.S.C. 154(b) by 953 days.

(21) Appl. No.: 12/060,733

(22) Filed: Apr. 1, 2008

(65) Prior Publication Data

US 2008/0310902 A1 Dec. 18, 2008

(30) Foreign Application Priority Data

Apr. 3, 2007 (JP) ..... 2007-097267

(51) Int. Cl.
*B41J 11/70* (2006.01)

(52) U.S. Cl. ..... 400/621; 400/611; 347/218

(58) Field of Classification Search ..... 400/611, 400/613; 347/219, 218
See application file for complete search history.

(56) References Cited

U.S. PATENT DOCUMENTS

| | | | | | |
|---|---|---|---|---|---|
| 5,354,136 | A | * | 10/1994 | Takizawa et al. | 400/185 |
| 5,437,444 | A | * | 8/1995 | Kawakami et al. | 271/22 |
| 2009/0162125 | A1 | * | 6/2009 | Kubota | 400/611 |

FOREIGN PATENT DOCUMENTS

| | | | |
|---|---|---|---|
| JP | 59152881 | A * | 8/1984 |
| JP | 03124468 | A * | 5/1991 |
| JP | 04073171 | A * | 3/1992 |
| JP | 2000062268 | A | 2/2000 |
| JP | 2003-237155 | | 8/2003 |
| JP | 2003237155 | A | 8/2003 |

* cited by examiner

*Primary Examiner* — Daniel J Colilla
(74) *Attorney, Agent, or Firm* — DLA Piper LLP (US)

(57) ABSTRACT

Provided herein is a feed drive device for a printer including: a feed roller that feeds a print medium in synchronization with drive of a print head; a motor constituting a driving source of the feed roller; a roller reduction gear train that transmits power from the motor to the feed roller; and a reverse rotation preventing mechanism that is incorporated in an input side of the roller reduction gear train and prevents reverse rotation of the feed roller; the reverse rotation preventing mechanism being operated by reverse rotational power of the feed roller reversely input to the roller reduction gear train to prevent reverse rotation of a first gear disposed in an input side of the roller reduction gear train.

5 Claims, 8 Drawing Sheets

FEED DRIVE DEVICE FOR PRINTER AND PRINTER

The entire disclosure of Japanese Patent Application No. 2007-097267, filed Apr. 3, 2007, is expressly incorporated by reference herein.

BACKGROUND

1. Technical Field

The present invention relates to a feed drive device for a printer for feed-driving a print medium, such as a printing tape, in synchronization with drive of a print head, and also relates to a printer.

2. Related Art

Feed drive devices of the above-described type have been known to have a feed roller that feeds a printing tape in synchronization with drive of a print head, a drive motor constituting a driving source of the feed roller, and a roller reduction gear train that transmits power from the drive motor to the feed roller. JP-A-2003-237155 is an example of related art. The drive motor includes a DC motor, and the main shaft of the drive motor is provided with an encoder.

In use of such a feed drive device, when stopping feed drive, the feed roller slightly reversely rotates. Specifically, when stopping feed drive, elastic deformation of the feed roller or the action of a spring for preventing reverse rotation of the printing tape, for example, causes the feed roller to slightly rotate in a direction opposite to the feeding direction of rotation. Such reverse rotation of the feed roller causes a problem that after stopping printing for a while and cutting the printing tape, a printing position shifts when printing is started again, and therefore, desired printing cannot be performed. One possible approach for solving such a problem is to incorporate a one-way clutch for preventing reverse rotation in the feed roller. However, reverse rotation due to "idle" that the one-way clutches have cannot be avoided. There is another problem such as an increase in costs.

SUMMARY

An advantage of some aspects of the invention is to provide a feed drive device for a printer and a printer that can reduce an amount of reverse rotation when a feed roller reversely rotates.

According to one aspect of the invention, there is provided a feed drive device for a printer including a feed roller that feeds a print medium in synchronization with drive of a print head, a motor constituting a driving source of the feed roller, a roller reduction gear train that transmits power from the motor to the feed roller, and a reverse rotation preventing mechanism that is incorporated in an input side of the roller reduction gear train and prevents reverse rotation of the feed roller, in which the reverse rotation preventing mechanism is operated by reverse rotational power of the feed roller reversely input to the roller reduction gear train to prevent reverse rotation of a first gear disposed in the input side of the roller reduction gear train.

According to this configuration, by incorporating the reverse rotation preventing mechanism into the input side of the roller reduction gear train, reverse rotation of the feed roller causes an increase in the speed of the reverse rotational power, and the reverse rotational power is transmitted to the reverse rotation preventing mechanism to operate the mechanism (for example, 5-degree rotation of an interlocked object operates the reverse rotation preventing mechanism, and when a deceleration from the feed roller to the first gear is 1/50, only 5×1/50=0.1 degrees of rotation in the feed roller allows stop of reverse rotation). Thereby, the interlocking nature can improve, and an amount of reverse rotation when the feed roller reversely rotates can be reduced. Therefore, backward feed of the print medium can be suppressed so that accurate printing processing can be performed to the print medium.

In this case, it is preferable that the feed drive device further includes a cutter reduction gear train that transmits power from the motor to a cutter, a clutch device that transmits forward rotational power of the motor to one of the roller reduction gear train and the cutter reduction gear train and transmits reverse rotational power to the other, in which the reverse rotation preventing mechanism prevents reverse rotation of the feed roller with the clutch device switched to the cutter reduction gear train.

According to this configuration, it is possible to suppress reverse rotation of the feed roller, occurring at every time a feeding operation is stopped to switch from the feeding operation to a cutting operation, and backward feed of the print medium caused by such reverse rotation of the feed roller. Therefore, accurate printing processing to the print medium can be performed.

In this case, it is preferable that the reverse rotation preventing mechanism has a carrier rotatably pivotally supported by a gear shaft of an adjacent gear that meshes with the first gear, and a planet gear meshed with the adjacent gear and rotatably pivotally supported by the carrier, and the planet gear engages with and disengages from the first gear in accordance with forward or reverse rotation of the adjacent gear.

According to this configuration, the planet gear in response to rotation of the adjacent gear meshes with the first gear, and then, the first gear stops. In other words, reverse rotation of the feed roller stops. In this case, use of the planet gear in the reverse rotation preventing mechanism makes a simpler configuration of the mechanism.

In this case, it is preferable that the adjacent gear is an input gear of the roller reduction gear train for inputting the power from the clutch device by switching.

According to this configuration, the adjacent gear that is the input gear of the roller reduction gear train makes a simpler configuration and provides more satisfactory interlocking nature of the reverse rotation preventing mechanism.

In this case, it is preferable that the feed drive device further includes an encoder that detects an amount of the print medium fed by the feed roller based on rotation of the motor, and a control device that controls drive of the motor and drive of the print head, in which the control device causes the feed roller to idly feed the print medium, prior to drive of the print head, by an amount of backward feed of the print medium detected by the encoder until the reverse rotation preventing mechanism prevents reverse rotation of the feed roller after the control device stops the motor.

According to this configuration, the reverse rotation preventing mechanism idly feeds the print medium by the amount of backward feed of the print medium that has not been prevented. Thus, influence of the backward feed on printing processing can be offset, and more accurate printing processing can be performed.

According to another aspect of the invention, there is provided a printer including any of the above-mentioned feed drive devices for a printer, and the print medium being a printing tape.

According to this configuration, by using the feed drive device that can decrease the amount of backward feed of the printing tape when stopping the feeding operation, accurate printing processing to the printing tape can be performed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a tape printer applied with a feed drive device for a printer according to one embodiment of the invention will be described with reference to the accompanying drawings. The tape printer (printer) executes desired printing on a printing tape (print medium) through key inputs, and has a function to cut off a printed portion of the printing tape. Pieces of the tape cut off are, for example, used as labels to be attached on documents files, distribution cables, etc.

Figure 1:
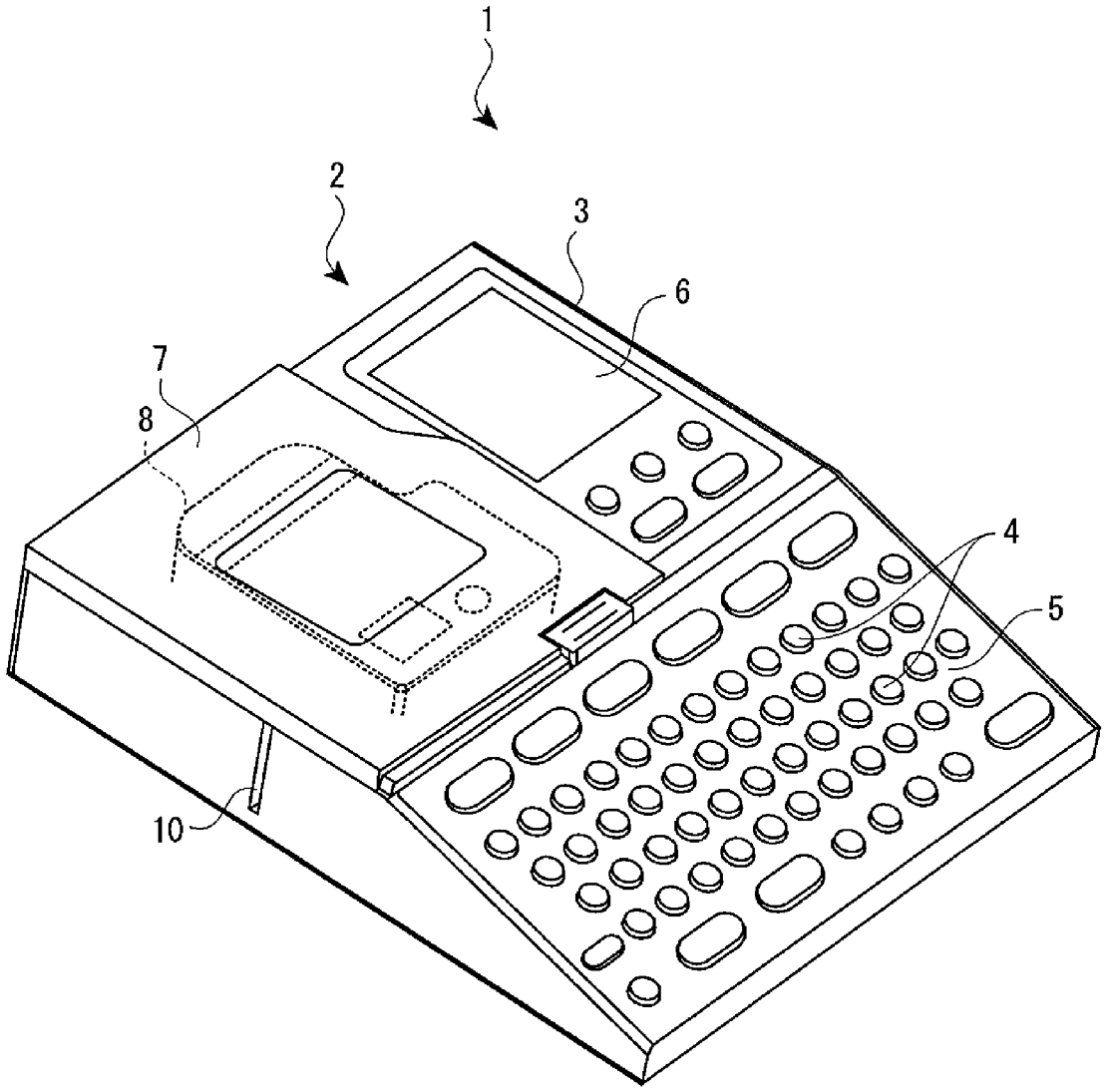
FIG. 1 is a perspective view illustrating a tape printer with its cover closed according to an embodiment of the invention.

As shown in FIG. 1, in the tape printer 1, a case 3 forms an outer shell of a main unit 2. A key input section 5 having various keys 4 is disposed in a front half portion of the tape printer 1. A liquid crystal display 6 for displaying an input result from the key input section 5 is disposed in an upper right side of a back half portion of the tape printer 1, and a lid 7 is disposed in an upper left side of the back half portion of the tape printer 1.

Figure 2:
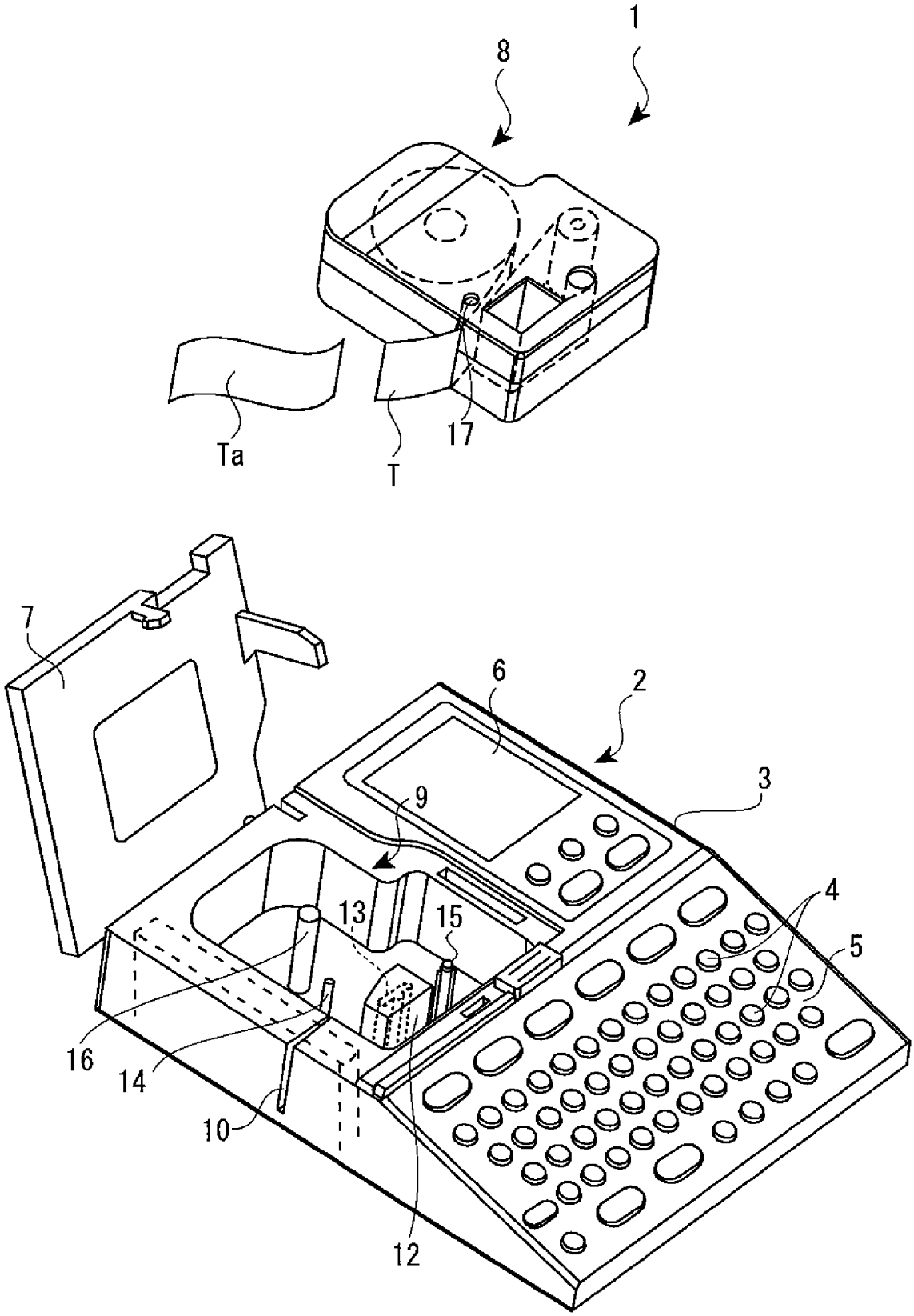
FIG. 2 is a perspective view illustrating the tape printer with its cover open according to the present embodiment.

As shown in FIG. 2, a cartridge mounting section 9 for mounting a tape cartridge 8 is disposed inside the lid 7. In addition, a tape ejecting slot 10 for communicating the cartridge mounting section 9 with an outside of the printer is formed in a left side portion of the case 3, and a tape cutter 11 for cutting a printing tape T fed out faces the tape ejecting slot 10.

A print head 13 covered with a head cover 12, a platen shaft 14 opposing to the print head 13, a take-up shaft 15 for taking up an ink ribbon, and a guiding boss 16 for guiding mounting of the tape cartridge 8 are erected in the cartridge mounting section 9. A platen roller (feed roller) 17 for engaging with the platen shaft 14 is mounted in the tape cartridge 8.

The platen roller 17, the platen shaft 14, and the take-up shaft 15 constitute a tape feeding mechanism 21 together with associated component parts described later, and the tape cutter 11 constitutes a tape cutting mechanism 22 together with associated component parts described later. The tape feeding mechanism 21 and the tape cutting mechanism 22 are operated by the same driving source (motor) through a power transmission mechanism 23 and a clutch mechanism 24 disposed in a bottom side of the cartridge mounting section 9 (details will be described later).

When creating a label Ta using the tape printer 1, first, the lid 7 is opened, and the tape cartridge 8 is mounted in the cartridge mounting section 9 from above. The tape cartridge 8 is mounted and the lid 7 is closed, putting the tape printer 1 into a printing standby condition. Subsequently, the key input section 5 is operated to input and/or edit as desired. When confirming on the liquid crystal display 6*a* that a desired input is obtained, the key input section 5 is further operated to command a print operation.

When the print operation is commanded, the tape feeding mechanism 21 causes the printing tape T and the ink ribbon of the tape cartridge 8 to simultaneously start traveling, and the desired printing is performed on the printing tape T by the print head 13. The ink ribbon is taken up within the tape cartridge 8 in accordance with advance of the print operation, and the printing tape T which has been printed is sent out to the outside of the printer from the tape ejecting slot 10. When printing is completed, the printing tape T and the ink ribbon are fed by an amount of a margin, and traveling of the printing tape T and the ink ribbon stops. Then, by the tape cutting mechanism 22, the tape cutter 11 is operated to cut off the printing tape T.

Now, with reference to FIGS. 3 and 4, a power system having the tape feeding mechanism 21 and the tape cutting mechanism 22 as an output end will be described in detail. The power system includes a motor 31 that is a power source; a drive unit 32 including a gear train connected to a main shaft of the motor 31; a clutch mechanism (clutch device) 24 connected to the drive unit 32; a power transmission mechanism 23 including a gear train 33 (roller reduction gear train) on the feeding mechanism side and a gear train 34 (cutter reduction gear train) on the cutting mechanism side both of which are selectively connected by the clutch mechanism 24; the tape feeding mechanism 21 connected to the gear train 33 on the feeding mechanism side; and the tape cutting mechanism 22 connected to the gear train 34 on the cutting mechanism side. In addition, the motor 31, the drive unit 32, the clutch mechanism 24, and the power transmission mechanism 23 are incorporated in a base frame 25 arranged in a bottom space of the cartridge mounting section 9. The power system constitutes a feed drive device for a printer referred to as in claims.

The motor 31 is configured to rotate in forward and reverse directions. When the motor 31 rotates forward, rotational power is transmitted from the drive unit 32 to the clutch mechanism 24, the clutch mechanism 24 is automatically switched to the gear train 33 on the feeding mechanism side, and the rotational power is further transmitted to the gear train 33 on the feeding mechanism side and the tape feeding mechanism 21. Thereby, the platen shaft 14 and the take-up shaft 15 rotate to simultaneously feed the printing tape T and the ink ribbon. On the other hand, when the motor 31 reversely rotates, the rotational power is transmitted from the drive unit 32 to the clutch mechanism 24, the clutch mechanism 24 is automatically switched to the gear train 34 on the cutting mechanism side, and the rotational power is further transmitted to the gear train 34 on the cutting mechanism side and to the tape cutting mechanism 22. Thereby, the tape cutter 11 executes a cutting operation to cut off the printing tape T.

A DC motor constitutes the motor 31, fixed to the base frame 25 in a vertical posture for higher space efficiency of the case 3. The drive unit 32 includes a worm 36 fixed to the main shaft of the motor 31, a worm wheel 37 that meshes with the worm 36, a wide gear 38 fixed on the same shaft as that of the worm wheel 37 underneath the worm wheel 37, and a spindle 39 for rotatably supporting the worm wheel 37 and the wide gear 38. A direction of the rotational power of the motor 31 is changed through the worm 36 and the worm wheel 37, and the rotational power of the motor 31 is input from the wide gear 38 into the clutch mechanism 24.

An encoder 61 for detecting an amount of rotation of the worm 36 is provided in the worm 36 to generate a driving signal for synchronizing a feeding operation of the printing tape T with drive of the print head 13. The encoder 61 includes a slit disc 62 pivotally attached to an end portion of the worm 36, and a photo interrupter (not shown) facing the slit disc 62.

The slit disc 62 rotates with the worm 36 and has a plurality of notch portions and a plurality of non-notch portions evenly disposed in a circumferential direction, thereby providing intermittent light from a light emitting device in the photo interrupter. The photo interrupter photoelectrically converts the intermittent state of the light to generate a pulse signal (driving signal), and sends the pulse signal to a control section (not shown). The control section drives and stops the motor 31 based on the driving signal, and additionally, the control section synchronizes timing of the tape feeding of the printing tape T with drive of the print head 13 to print on the printing tape T as desired. The driving signal is used to detect an amount of backward feed of the printing tape T, which will be described in greater detail later.

Figure 5:
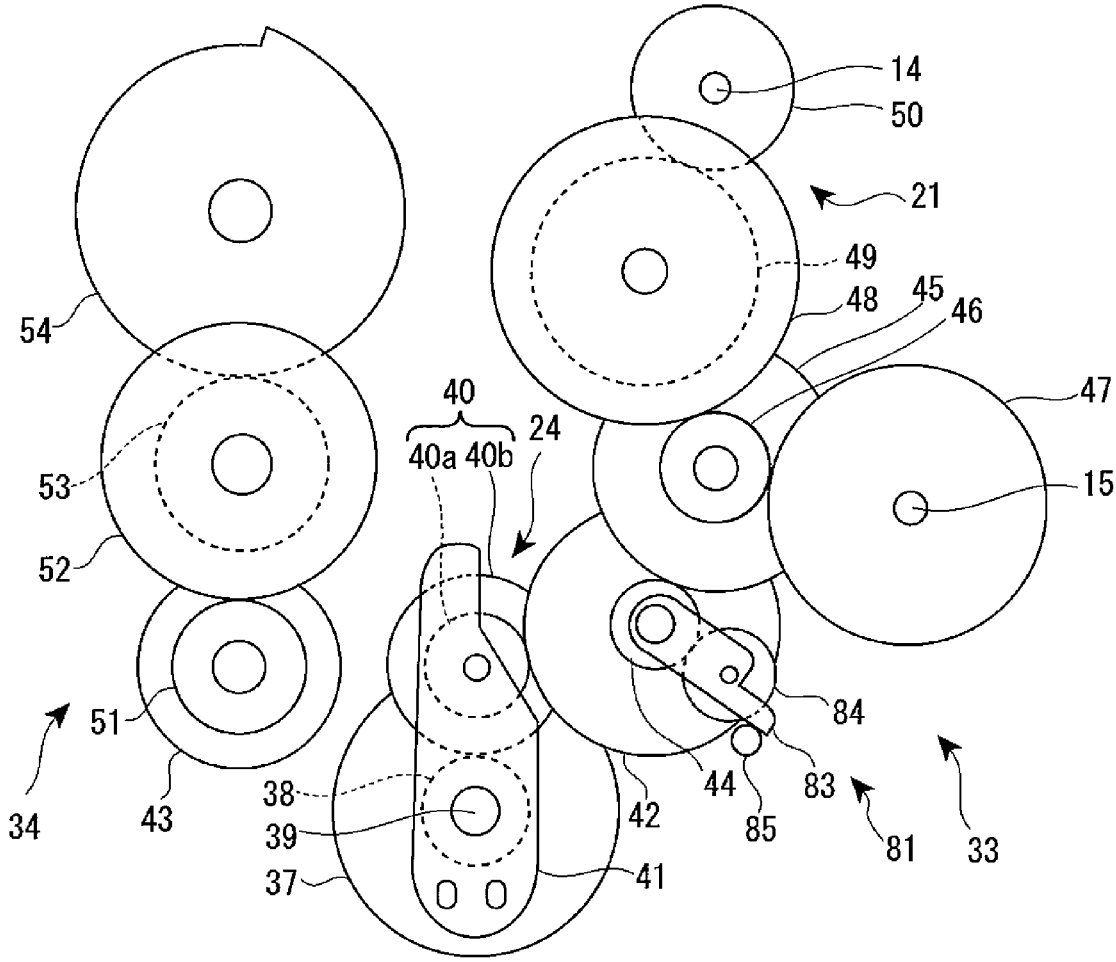
FIG. 5 is a bottom plan view illustrating gear trains in the power system of the tape printer according to the present embodiment.
Figure 6A:
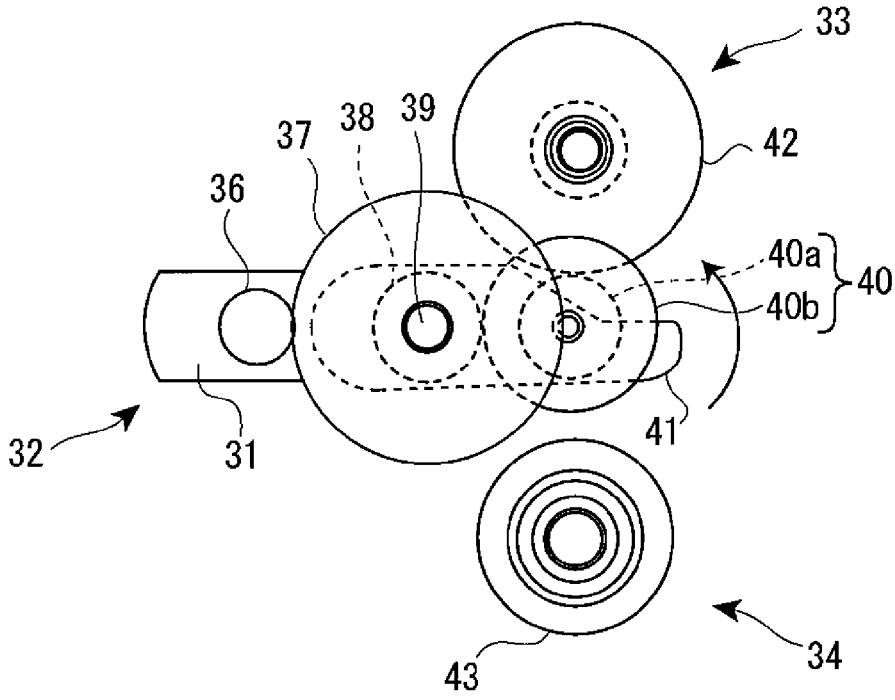
FIGS. 6A and 6B are plan views illustrating a clutch mechanism and component parts associated therewith in the power system of the tape printer according to the present embodiment.
Figure 6B:
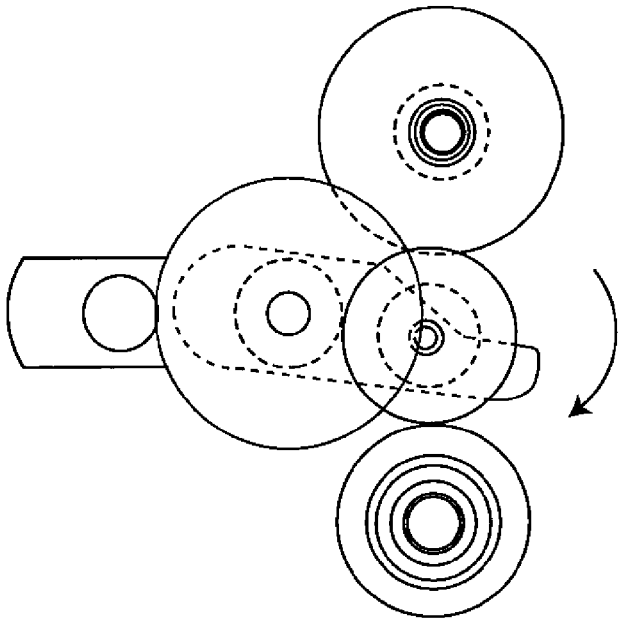

As shown in FIGS. 5, 6A and 6B (FIG. 5 is shown up side down), the clutch mechanism 24 has a planet gear of a clutch part 40 that meshes with the wide gear 38 of the drive unit 32, and a carrier of the clutch part 41 that rotatably pivotally supports the planet gear of the clutch part 40 at an end of the carrier 41 and that is co-rotatably pivotally supported by the above-mentioned spindle 39. The planet gear of the clutch part 40 is formed of a planet gear of a clutch lower part 40*a* with a smaller diameter provided on a bottom side of the clutch part, and a planet gear of a clutch upper part 40*b* with a larger diameter provided on an upper side of the clutch part and fixed on the same shaft as that of the planet gear 40*a*.

When the motor 31 rotates forward to rotate the wide gear 38, the carrier 41 of the clutch part rotates (is swung) in a manner of co-rotating with the wide gear 38 due to friction therewith, so that the planet gear of the clutch lower part 40*a* meshes with an input gear 42 on the feeding side provided in the gear train 33 on the feeding mechanism side. Rotation of the wide gear 38 is transmitted to the planet gear of the clutch upper part 40*b* that meshes with the wide gear 38. At a moment that the planet gear of the clutch lower part 40*a* meshes with the input gear 42 on the feeding side, rotation of the wide gear 38 is transmitted from the planet gear of the clutch lower part 40*a* to the input gear 42 on the feeding side to rotate the input gear 42 on the feeding side (see FIG. 6A). Similarly, when the motor 31 reversely rotates, the wide gear 38 rotates in a direction opposite to that mentioned above. Then, the carrier of the clutch part 41 rotates in a direction opposite to that mentioned above so that the planet gear of the clutch upper part 40*b* meshes with an input gear 43 on the cutting side provided in the gear train 34 on the cutting mechanism side. Rotation of the wide gear 38 is transmitted to the planet gear of the clutch upper part 40*b*. At a moment that the planet gear of the clutch upper part 40*b* meshes with the input gear 43 on the cutting side, rotation of the wide gear 38 is transmitted from the planet gear of the clutch upper part 40*b* to the input gear 43 on the cutting side to rotate the input gear 43 on the cutting side (see FIG. 6B).

Figure 3:
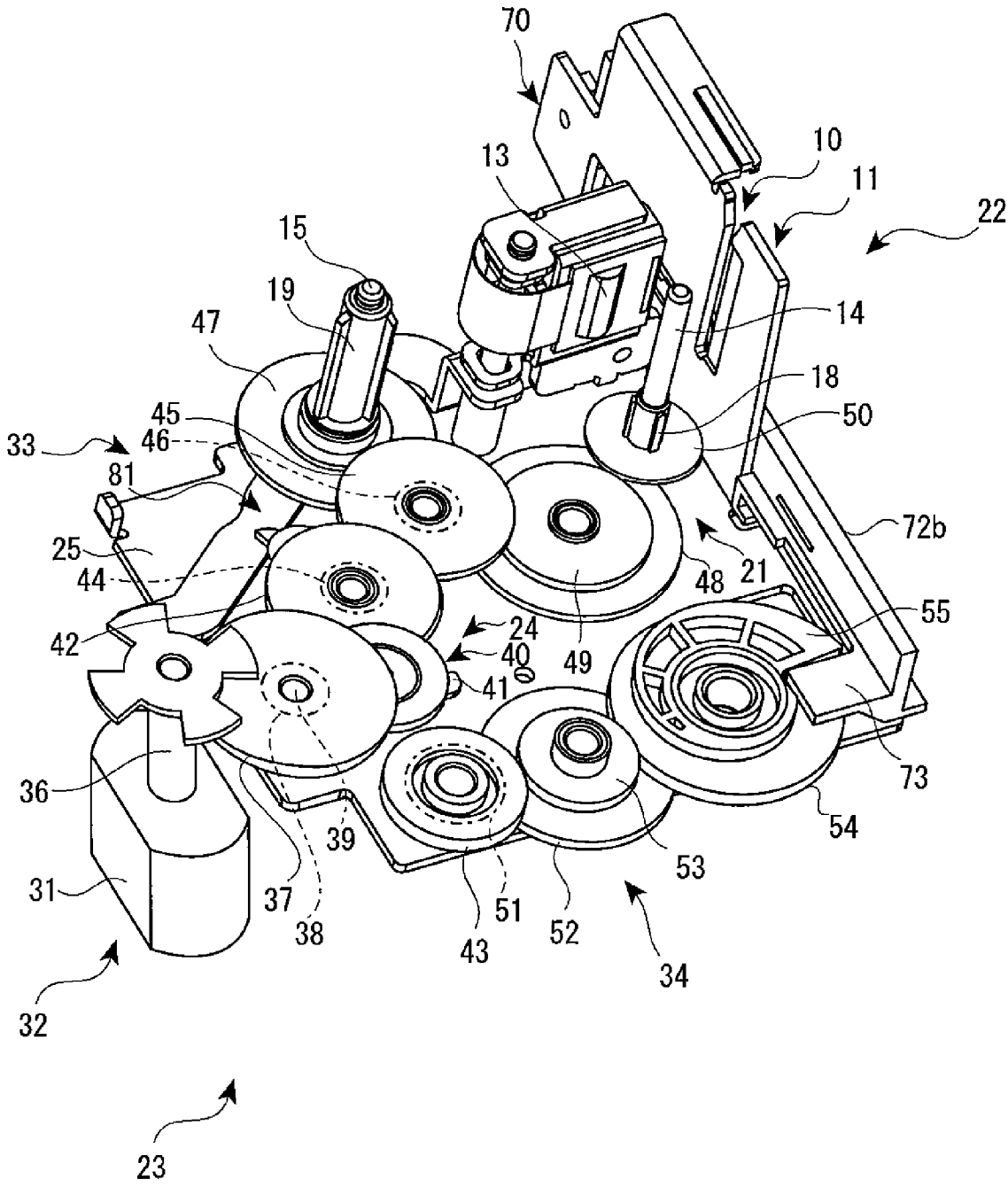
FIG. 3 is a perspective view illustrating the whole power system of the tape printer according to the present embodiment.
Figure 4:
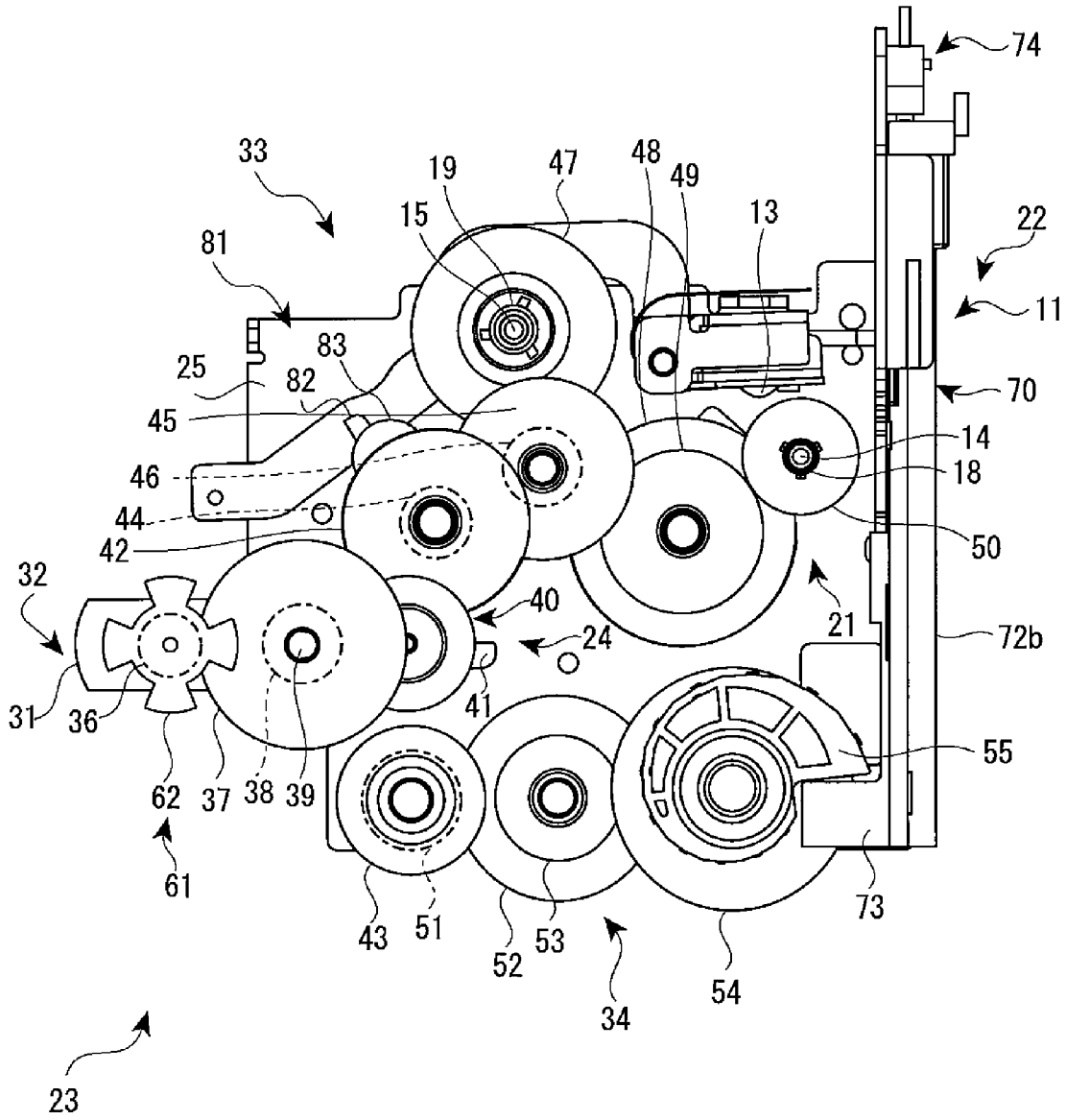
FIG. 4 is a plan view illustrating the whole power system of the tape printer according to the present embodiment.

As shown in FIGS. 3 through 5, the gear train 33 on the feeding mechanism side includes the above-mentioned input gear 42 of the feeding side, a first middle gear 44 of the feeding side fixed on the same shaft as that of the input gear 42 of the feeding side underneath the input gear 42, a second middle gear 45 of the feeding side that meshes with the first middle gear 44 of the feeding side, a branch gear 46 fixed on the same shaft as that of the second middle gear 45 of the feeding side underneath the second middle gear 45, a take-up gear 47 on the side of the take-up shaft 15 that meshes with the branch gear 46, a reduction gear 48 on the side of the platen shaft 14 that meshes with the branch gear 46 in the same way, a third middle gear 49 of the feeding side fixed on the same shaft as that of the reduction gear 48 on a top of the reduction gear 48, and a platen gear 50 that meshes with the third middle gear 49 of the feeding side. A "first gear" referred to as in claims is the second middle gear 45 of the feeding side. An "input gear" referred to as in claims is configured in combination of the input gear 42 of the feeding side and the first middle gear 44 of the feeding side that share the same gear shaft.

The rotational power of the motor 31 input into the input gear 42 of the feeding side is branched by the branch gear 46 through the first and second middle gears 44 and 45 of the feeding side to rotate the platen gear 50 through the take-up gear 47 and the third middle gear 49 of the feeding side. When rotational power caused by withdrawing the printing tape T by a user, etc. is applied to the platen gear 50, the input gear 42 of the feeding side pushes away the planet gear of the clutch part 40 to shut off this rotational power, and in this state, the take-up gear 47 is rotated through the branch gear 46 without receiving a load of the motor 31. Thereby, the ink ribbon is taken up in accordance withdrawal of the printing tape T, preventing slack of the ink ribbon. In addition, a reverse rotation preventing mechanism 81 for preventing reverse rotation of the platen roller 17 is incorporated in the gear train 33 on the feeding mechanism side (details will be described later).

The gear train 34 on the cutting mechanism side includes the above-mentioned input gear 43 of the cutting side, a first middle gear 51 of the cutting side fixed on the same shaft as that of the input gear 43 of the cutting side underneath the input gear 43, a second middle gear 52 of the cutting side that meshes with the first middle gear 51 of the cutting side, a third middle gear 53 of the cutting side fixed on a top of the second middle gear 52 of the cutting side, an operating gear 54 that meshes with the third middle gear 53 of the cutting side, and a rocking cam 55 fixed to an end of the operating gear 54. The rotational power of the motor 31 input into the input gear 43 of the cutting side is transmitted from the operating gear 54 through the first, second, and third middle gears 51, 52, and 53 of the cutting side to the rocking cam 55 to rotate the rocking cam 55.

The tape feeding mechanism 21 has the platen roller 17 that is brought into rolling contact with and feeds the printing tape T and the ink ribbon, a spline member 18 that fits into the platen roller 17, a platen shaft 14 for rotatably supporting the platen roller 17 through the spline member 18, and a take-up shaft 15 for taking up the ink ribbon. The platen roller 17 is incorporated into the tape cartridge 8. When the cartridge mounting section 9 is mounted on the tape cartridge 8, the platen roller 17 engages with the platen shaft 14 (spline member 18). The platen shaft 14 is fixed to the base frame 25 by a cantilever method, and a platen gear 50 and the spline member 18 formed to be integrated therewith are rotatably supported on the base side of the platen shaft 14. Rotation of the platen roller 14 causes the platen roller 17 to rotate through the spline member 18.

The take-up shaft 15 is fixed to the base frame 25 by a cantilever method, and a take-up gear 47 formed on the base side of the take-up shaft 15 and a take-up spline member 19 pivotally attached on the same shaft as that of the take-up gear 47 are rotatably supported. Rotation of the take-up gear 47 (the take-up spline member 19) causes a take-up core of the ink ribbon engaged with the take-up gear 47 to rotate. The take-up shaft 15 is a slide shaft having a coil spring therein, and takes up the ink ribbon while suitably sliding and rotating. Thereby, a tape feeding operation of the printing tape T is performed, and drive of the print head 13 in accordance with the tape feeding operation provides desired printing to the printing tape T.

Figure 7:
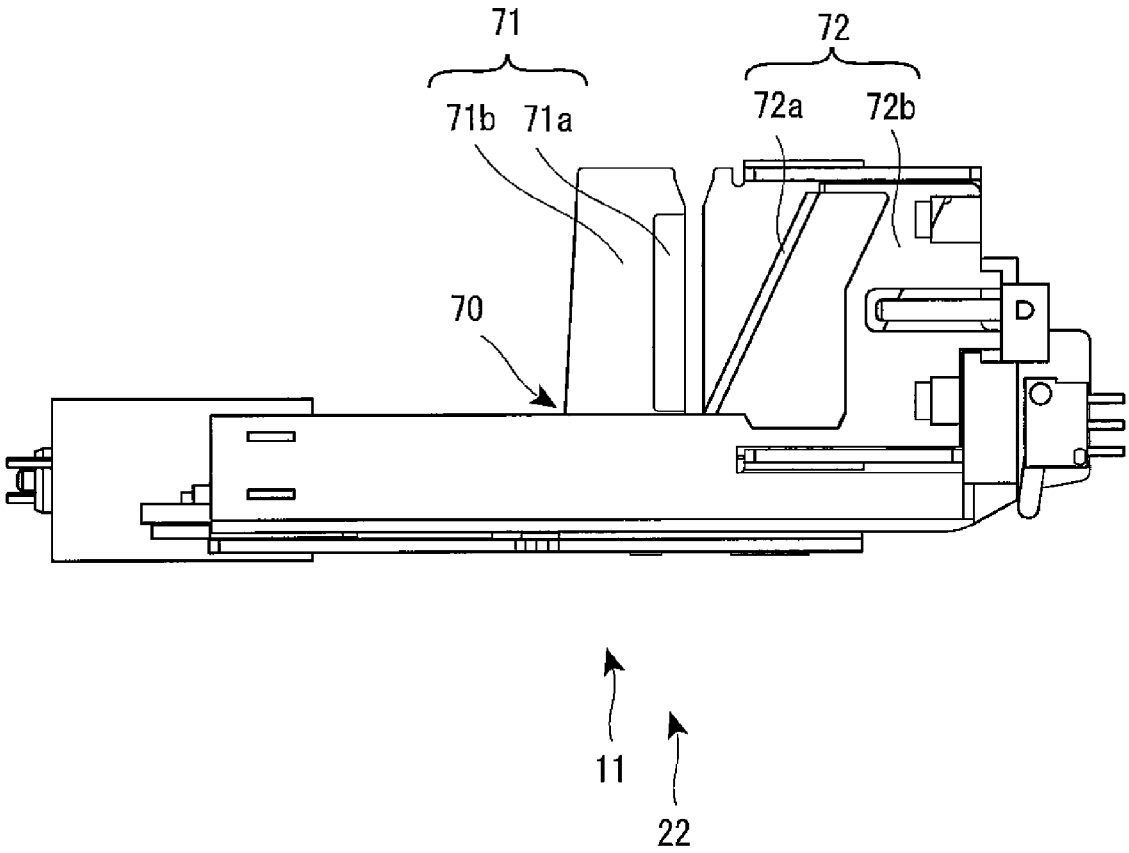
FIG. 7 is a side elevational view illustrating a tape cutting mechanism included in the tape printer according to the present embodiment.

As shown in FIGS. 3 and 7, the tape cutting mechanism 22 has a tape cutter 11 for horizontally sliding to cut off the printing tape T, and a cutter frame 70 that supports the tape cutter 11 and is erected on an end portion of the base frame 25. The tape cutter 11 includes a fixed blade portion 71 having a fixed blade 71*a* and a fixed blade holder 71*b* for holding the fixed blade 71*a*, and a movable blade portion 72 having a movable blade 72*a* and a movable blade holder 72*b* for holding the movable blade 72*a*. The fixed blade holder 71*b* also forms a tape feeding slit of the cutter frame 70, and to the fixed blade holder 71*b*, the fixed blade 71*a* is attached in parallel to the printing tape T. On the other hand, the movable blade holder 72*b* with an "L"-shape is arranged along with an outer side of the cutter frame 70, and is slidably supported on the cutter frame 70. The movable blade 72*a* formed of an oblique blade is attached to an upper portion of the movable blade holder 72*b*, facing the fixed blade 71*a*.

A cam follower 73 is integrally formed in a tail end of the movable blade holder 72*b*. The cam follower 73 engages with the above-mentioned rocking cam 55. When the cam follower 73 receives rotation of the rocking cam 55, the movable blade 72 is operated to cut. A position detecting switch 74 is fixed to the cutter frame 70, facing a leading end side of the movable blade holder 72. The position detecting switch 74 detects a home position of the movable blade 72 (tape cutter 11).

Now, a reverse rotation preventing mechanism 81 incorporated in the gear train on the side of the feed mechanism 33 will be described in detail. The reverse rotation preventing mechanism 81 suppresses reverse rotation of the platen roller 17 at the time of switching of the clutch mechanism 24. That is, reverse rotation (rotation in a direction opposite to a feeding direction) of the platen roller 17 is caused due to elastic deformation of the platen roller 17, an action of a spring for preventing reverse rotation of the printing tape T, etc. when drive of the motor 31 is stopped for the clutch mechanism 24 to switch connection with the motor 31 from the tape feeding mechanism 21 to the tape cutting mechanism 22. The reverse rotation preventing mechanism 81 prevents this reverse rotation of the platen roller 17 (strictly speaking, an amount of this reverse rotation is reduced).

Figure 8A:
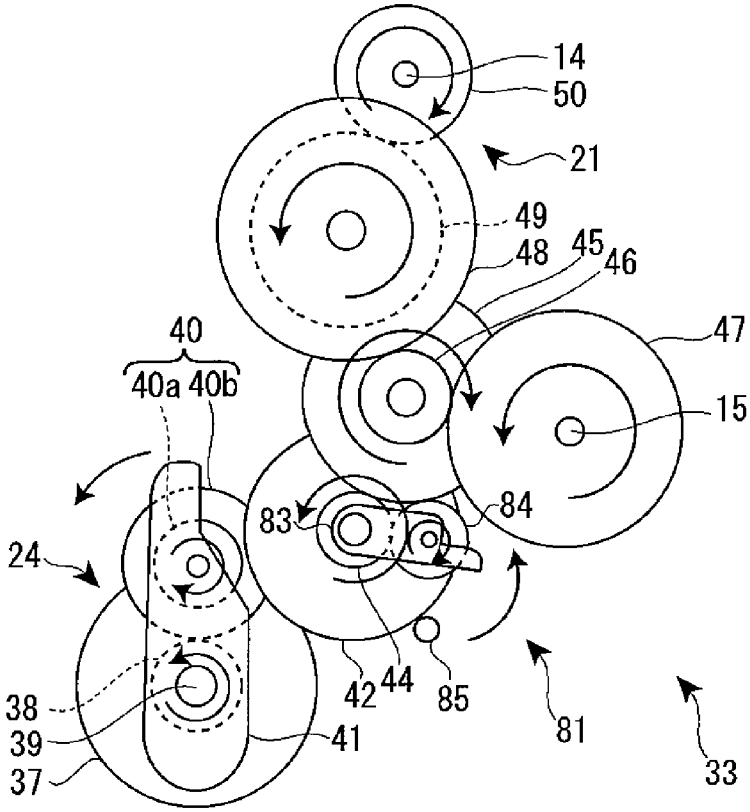
FIGS. 8A and 8B are bottom plan views illustrating a reverse rotation preventing mechanism and component parts associated therewith in the power system of the tape printer according to the present embodiment.
Figure 8B:
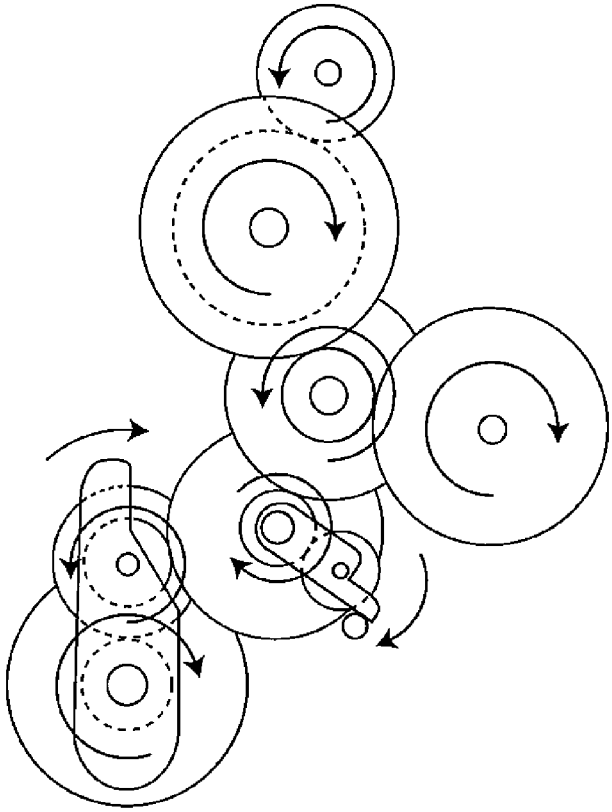

As shown in FIGS. 3 through 5, FIGS. 8A and 8B (FIGS. 5, 8A and 8B are illustrated up side down), the reverse rotation preventing mechanism 81 includes a carrier of a reverse rotation preventing part (carrier) 83 rotatably pivotally supported on the gear shaft to which the input gear 42 of the feeding side and the first middle gear 44 of the feeding side are fixed, and a planet gear of the reverse rotation preventing part (planet gear) 84 that meshes with the first middle gear 44 of the feeding side and that is rotatably pivotally supported by the carrier of the reverse rotation preventing part 83.

When the platen roller 17 reversely rotates, the reverse rotational power causes the first middle gear 44 of the feeding side (input gear 42 of the feeding side) to rotate through the platen gear 50, the third middle gear 49 of the feeding side, the reduction gear 48, the branch gear 46, and the second middle gear 45 of the feeding side. When the first middle gear 44 of the feeding side rotates, the planet gear of the reverse rotation preventing part 84 meshed with the first middle gear 44 of the feeding side rotates interlocked with the first middle gear 44, and simultaneously, due to friction with the first middle gear 44 of the feeding side, the carrier of the reverse rotation preventing part 83 rotates (is swung) so that the planet gear of the reverse rotation preventing part 84 meshes with the second middle gear 45 of the feeding side (see FIG. 5A). Thereby, a power transmitted from the platen roller 17 side and a power transmitted from the planet gear of the reverse rotation preventing part 84 are offset on the second middle gear 45 of the feeding side and the branch gear 46 to stop reverse rotation of the platen roller 17. When the input gear 42 of the feeding side (the first middle gear 44 of the feeding side) rotates forward (rotates in the feeding direction), the carrier of the reverse rotation preventing part 83 rotates in the direction opposite to the direction (see FIG. 8A), and departs from the second middle gear 45 of the feeding side to normally drive the tape feeding mechanism 21 (see FIG. 8B). In the rotation orbit of the carrier of the reverse rotation preventing part 83, a stopper 85 for restricting rotation of the carrier of the reverse rotation preventing part 83 is arranged in a side opposite to the second middle gear side of the feeding side 45, and the carrier of the reverse rotation preventing part 83 rotates between the stopper 85 and the second middle gear 45 of the feeding side.

Thus, by incorporating the reverse rotation preventing mechanism 81 in the input side of the gear train 33 on the feeding mechanism side (the second middle gear 45 of the feeding side), reverse rotation of the platen roller 17 causes an increase in the speed of the reverse rotational power, and the reverse rotational power is transmitted to the reverse rotation preventing mechanism 81 to operate the reverse rotation preventing mechanism 81 (for example, when 5-degree rotation of an interlocked object (the first middle gear 44 of the feeding side) operates the reverse rotation preventing mechanism 81, and when a deceleration from the platen roller 17 to the branch gear 46 is $1/50$, only $5\times1/50=0.1$ degree of rotation in the platen roller 17 allows stop of reverse rotation.) Thereby, the interlocking nature in prevention of reverse rotation improves, and the amount of reverse rotation at the time of reverse rotation in the platen roller 17 may be reduced. Therefore, backward feed of the printing tape T may be suppressed, and accurate printing may be performed to the printing tape T.

The reverse rotation preventing mechanism 81 suppresses reverse rotation of the platen roller 17 but only decreases the amount of reverse rotation of the platen roller 17. When only the reverse rotation preventing mechanism 81 is used, influence of reverse rotation cannot be offset. Therefore, the above-mentioned encoder 61 and the control section idly feed the printing tape T by an amount of backward feed of the printing tape T. That is, when stopping the motor 31 to switch from a print operation (feeding operation) to a cutting operation, the encoder 61 detects an amount of reverse rotation transmitted from the platen roller 17 to the worm 36 through each gear, and then, the control section idly feeds the printing tape T by the amount of reverse rotation. Thereby, influence by reverse rotation of the platen roller 17 may be offset, and the print operation may be started from the same state as a state when having stopped the print operation. For example, when a length of a front margin is set to be shorter than a distance from the print head to the cutter, printing may be stopped on the way for the cutting operation. Even in such a case, a printing position does not shift at the time of re-start of printing after the cutting operation. Thereby, more accurate printing may be performed. Idle feeding may be performed immediately after stopping the motor 31, or when re-starting the print operation.

With the above-mentioned configuration, by incorporating the reverse rotation preventing mechanism 81 in the input side of the gear train 33 on the feeding mechanism side, reverse rotation of the platen roller 17 causes an increase in the speed of the reverse rotational power, and the reverse rotational power is transmitted to the reverse rotation preventing mechanism 81 to operate the reverse rotation preventing mechanism 81. Thereby, the interlocking nature improves, and the amount of reverse rotation at the time of reverse rotation in the platen roller 17 may be reduced. Therefore, backward feed of the printing tape T may be suppressed, and accurate printing may be performed to the printing tape T.

While the feed drive device according to the invention is used for the tape printer 1 for printing on the printing tape T in the present embodiment, alternative printers (printing apparatuses) that can feed a print medium in synchronization with drive of the print head 13 may also be used.

In addition, while the feed drive device according to the invention is used for the tape printer 1 in which the clutch mechanism 24 performs interlocked switching of the power in the present embodiment, the feed drive device according to the present embodiment may also be applicable to alternative printers in which the platen roller 17 may reversely rotate even when the clutch mechanism 24 is not included. Furthermore, while the feed drive device that uses the planet gear mechanism as the reverse rotation preventing mechanism 81 is used in the present embodiment, ratchets or the like may also be used as long as it is possible to stop reverse rotation of the platen roller 17. However, use of the planet gear mechanism in the present embodiment makes a simpler configuration of the reverse rotation preventing mechanism 81 that stably operates.

Furthermore, while the carrier of the reverse rotation preventing part 83 and the planet gear of the reverse rotation preventing part 84 are provided on the gear shaft of the input gear 42 of the feeding side and first middle gear 44 of the feeding side of the gear train 33 on the feeding mechanism side in the present embodiment, an additional gear may be provided and the above-mentioned members may be provided thereto. An alternative configuration may also be used such that the carrier of the reverse rotation preventing part 83 and the planet gear of the reverse rotation preventing part 84 are provided on the gear shaft of the second middle gear 45 of the feeding side and the branch gear 46, and the planet gear of the reverse rotation preventing part 84 meshes with the first middle gear 44 and take-up gear 47 of the feeding side. However, by providing the carrier of the reverse rotation preventing part 83 and the planet gear of the reverse rotation preventing part 84 on the gear shaft of the input gear 42 of the feeding side and of the first middle gear 44 of the feeding side in the present embodiment, thereby providing a simpler configuration having more satisfactory interlocking nature of the reverse rotation preventing mechanism 81.

What is claimed is:

1. A feed drive device for a printer, comprising:

a feed roller that feeds a print medium in synchronization with drive of a print head;

a motor constituting a driving source of the feed roller;

a roller reduction gear train that transmits power from the motor to the feed roller;

a reverse rotation preventing mechanism that is incorporated on an input gear of the roller reduction gear train and prevents reverse rotation of the feed roller;

a cutter reduction gear train that transmits power from the motor to a cutter; and a clutch device that transmits forward rotational power of the motor to one of the roller reduction gear train and the cutter reduction gear train and transmits reverse rotational power to the other;

the reverse rotation preventing mechanism being operated by reverse rotational power of the feed roller reversely input to the roller reduction gear train to prevent reverse rotation of a first gear disposed on the input gear of the roller reduction gear train, and the reverse rotation preventing mechanism prevents reverse rotation of the feed roller with the clutch device switched to the cutter reduction pear train.

2. The feed drive device for a printer according to claim 1, wherein the reverse rotation preventing mechanism has:

a carrier rotatably pivotally supported by a gear shaft of the input gear that meshes with the first gear; and a planet gear meshed with the input gear and rotatably pivotally supported by the carrier, and the planet gear engages with and disengages from the first gear in accordance with forward or reverse rotation of the input gear.

3. The feed drive device for a printer according to claim 2, wherein the input gear is an input gear of the roller reduction gear train for inputting the power from the clutch device switched from the cutter reduction gear train to the roller reduction gear train.

4. The feed drive device for a printer according to claim 1, further comprising:

an encoder that detects an amount of the print medium fed by the feed roller based on rotation of the motor; and a control device that controls drive of the motor and drive of the print head; wherein the control device causes the feed roller to idly feed the print medium, prior to drive of the print head, by an amount of backward feed of the print medium detected by the encoder until the reverse rotation preventing mechanism prevents reverse rotation of the feed roller after the control device stops the motor.

5. A printer, comprising:

the feed drive device for a printer according to claim 1; the print medium being a printing tape.

* * * * *